US006328455B1

(12) United States Patent
Helbig

(10) Patent No.: US 6,328,455 B1
(45) Date of Patent: Dec. 11, 2001

(54) ELECTRIC LAMP AND AN ILLUMINATING SYSTEM HAVING SUCH AN ELECTRIC LAMP

(75) Inventor: Peter Helbig, Sontheim (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/448,011

(22) Filed: Nov. 23, 1999

(30) Foreign Application Priority Data

Dec. 1, 1998 (DE) ..... 198 55 265

(51) Int. Cl.[7] ..... F21K 27/00

(52) U.S. Cl. ..... 362/226; 362/548; 362/519; 362/267

(58) Field of Search ..... 362/224, 519, 362/267, 548; 313/318.11, 318.1, 318.09, 318.08, 318.12; 439/617, 619, 618, 699.2, 702

(56) References Cited

U.S. PATENT DOCUMENTS 4,412,273 10/1983 Helbig .
4,947,294 * 8/1990 Van Duyn et al. ..... 362/61
5,839,818 * 11/1998 Jannson et al. ..... 362/226
5,957,569 * 9/1999 Helbig et al. ..... 362/263
6,080,019 * 6/2000 Coushaine ..... 439/611
6,095,866 * 8/2000 Helbig et al. ..... 439/619
6,210,021 * 4/2001 Hlebig et al. ..... 362/226

FOREIGN PATENT DOCUMENTS

3426712 A1 1/1986 (DE) .
3521962 A1 1/1987 (DE) .
0 467 062 A2 1/1992 (EP) .
1 539 667 1/1979 (GB) .
WO 97/25733 7/1997 (WO) .

* cited by examiner

*Primary Examiner*—Stephen Husar
*Assistant Examiner*—Anabel Ton
(74) *Attorney, Agent, or Firm*—William E. Meyer

(57) ABSTRACT

The invention relates to an electric lamp, provided with a metal-plastic cap, for a motor vehicle headlight. In order to prevent maladjustment of the lamp, caused by the formation of burrs on the reflector (20), during installation in the mounting opening (21), designed as a lampholder, of the reflector (20), the lamp cap (14*b*) is fitted with depressions (14*f*) or cutouts so that any possible burr (22*a*2) on the edge (22*a*) of the mounting opening (21) is arranged free from contact with the lamp cap (14*b*, 15).

2 Claims, 3 Drawing Sheets

ELECTRIC LAMP AND AN ILLUMINATING SYSTEM HAVING SUCH AN ELECTRIC LAMP

TECHNICAL FIELD

The invention relates to electric lamps and particularly to automobile lamps. More particularly the invention is concerned with the coupling structure of an automobile lamp.

BACKGROUND ART

Such an electric lamp is disclosed, for example, in the International Patent Application WO 97/25733. This laid-open application describes an electric incandescent lamp, in particular a motor vehicle headlight lamp, having an incandescent filament enclosed in a vitreous lamp bulb, and a lamp cap consisting of metal parts and plastic parts. The pinch foot, sealed in a gas-tight fashion, of the lamp bulb is fixed in a metal holder part which is, for its part, connected directly or via an intermediate ring to a metal, ringshaped support sleeve. The metal support sleeve is anchored in the plastic cap part, equipped with the electric terminals of the lamp, of the lamp cap. To mount the lamp in the opening, designed as a lampholder, of a reflector, the ring-shaped support sleeve has three reference noses which are arranged in one plane, are distributed equidistantly over the circumference of the support sleeve and engage in the lamp mounting opening of the reflector, and a press-on spring, acting radially outwards, which bears with a clamping fit against the edge of the lamp mounting opening of the reflector. Below the three reference noses, the support sleeve respectively has a point of contact with the edge of the lamp mounting opening of the reflector. One of these points of contact is formed by the press-on spring. The three reference noses are situated on the inner side of the reflector. The sealing of the lamp mounting opening, designed as a lampholder, of the reflector is performed by means of a silicone sealing ring which is arranged between the reflector outer side and the plastic cap part of the lamp cap. This lamp cap, constructed from metal parts and plastic parts, ensures, on the one hand, by means of its metal holder parts for the lamp bulb an exact adjustment of the position of the incandescent filament with respect to the reference plane defined by the three reference noses and, by means of its plastic cap part, adequate sealing of the lamp cap and the reflector against moisture. However, a burr, formed during the production of the reflector, on the outer edge of the lamp mounting opening of the reflector has an unfavorable influence on the mounting position of the lamp, and causes an undesired maladjustment of the incandescent filament with respect to the optical axis of the reflector.

DISCLOSURE OF THE INVENTION

An electric lamp may be made with a lamp cap and a transparent lamp bulb, and having at least one luminous means surrounded by the lamp bulb, the lamp cap having a metal holder part in which the lamp bulb is fixed, the lamp cap having a ring-shaped metal support sleeve connected to the holder part and a plastic cap part which is provided with the electric terminals of the lamp and in which the support sleeve is anchored, the support sleeve having three reference noses lying in a common plane arranged perpendicular to the ring axis, the reference noses serving to engage in an opening, designed as a lampholder, of a reflector, and the ring-shaped support sleeve having a press-on spring which acts radially outwards and serves to fix the lamp in the opening, designed as a lampholder, of the reflector, the press-on spring being arranged below a first reference nose ,characterized in that on its outer side, below the second and third reference nose, the ring-shaped support sleeve in each case has a depression or a cutout at a distance from the reference noses.

BEST MODE FOR CARRYING OUT THE INVENTION

Figure 1:
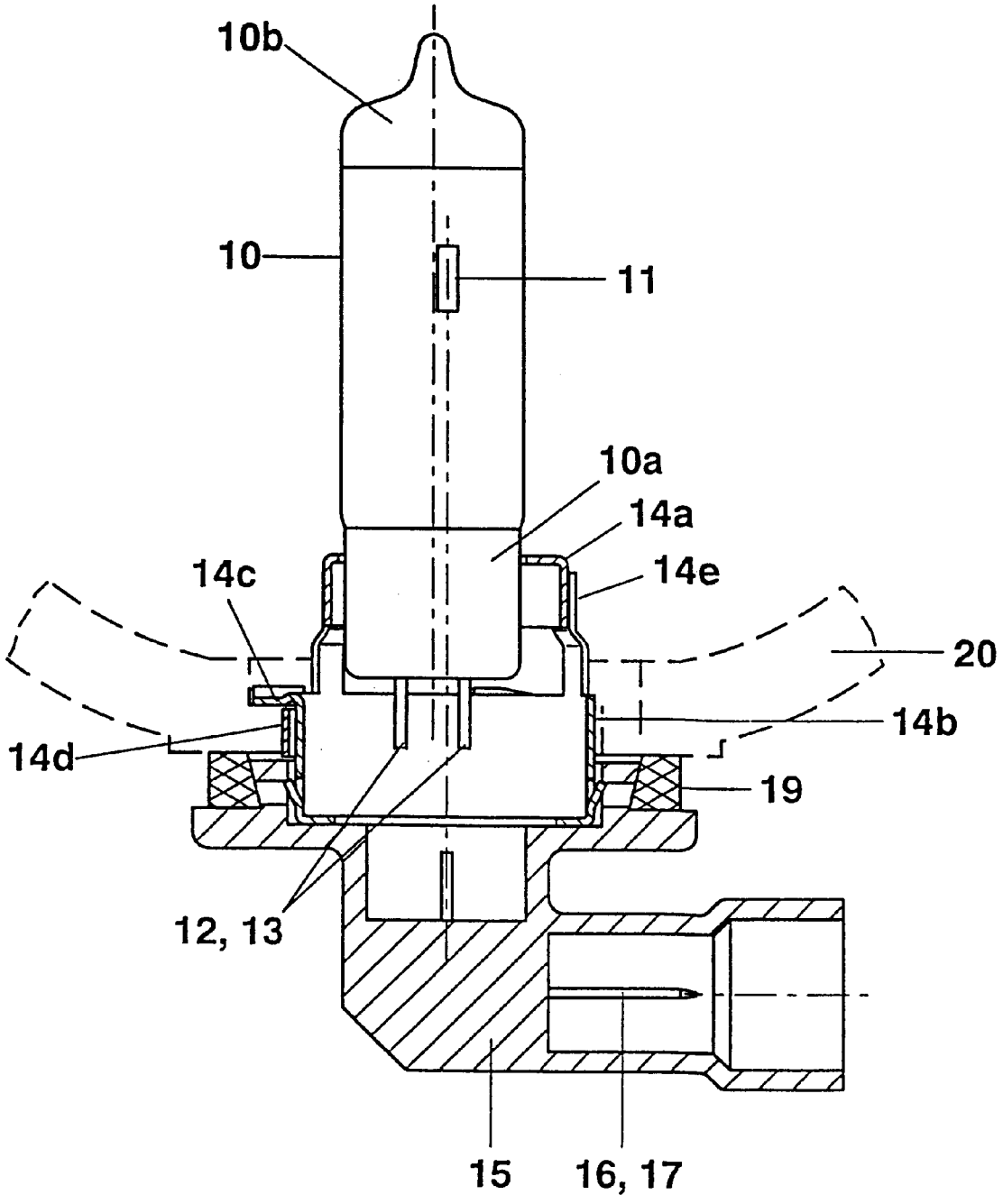
FIG. 1 shows a diagrammatic representation of the preferred embodiment showing a reflector, partially sectioned.

It is the object of the invention to provide an electric lamp having an improved lamp cap, in the case of which the disadvantage of the lamps in accordance with the prior art is avoided. In particular, the aim is for the lamp according to the invention to be capable of being mounted without any problem with the correct position of the incandescent filament with reference to the optical axis of the reflector despite any possible formation of burrs on the lamp mounting opening of the reflector.

The electric lamp according to the invention has a lamp cap, a transparent lamp bulb and at least one luminous means surrounded by the lamp bulb. The lamp cap has a metal holder part in which the lamp bulb is fixed, and a metal, ring-shaped support sleeve connected to the holder part, as well as a plastic cap part which is provided with the electric terminals of the lamp and in which the support sleeve is anchored. The ring-shaped support sleeve has three reference noses lying in a common plane arranged perpendicular to the ring axis, which serve to engage in a mounting opening, designed as a lampholder, of a reflector, and a press-on spring which acts radially outwards and serves to fix the lamp in the opening, designed as a lampholder, of the reflector, the press-on spring being arranged below a first reference nose. According to the invention, on its outer side, below the second and third reference nose, the ring-shaped support sleeve in each case has a depression or a cutout at a distance from the reference noses. Consequently, any possible burr on the lamp mounting opening of the reflector has no points of contact with the lamp cap. The maladjustment of the position of the luminous means with reference to the reflector axis is prevented in this way, since the three points of contact of the support sleeve with the edge of the lamp mounting opening of the reflector are arranged outside the region of the lamp mounting opening which is possibly affected by a burr.

In addition to the lamp with the features described above, the illuminating system according to the invention has a reflector which has a reflector inner side facing the lamp bulb and a reflector outer side averted from the lamp bulb, as well as a light exit opening and a lamp mounting opening designed as a lampholder. This lamp mounting opening is delimited by an edge which has an inner edge on the reflector inner side and an outer edge on the reflector outer side. The reference noses of the lamp engage in the lamp mounting opening and bear against the reflector on the reflector inner side. The press-on spring bears against the edge of the lamp mounting opening and defines a first point of contact between the lamp cap and the edge of the lamp mounting opening. The support sleeve bears against the edge of the mounting opening below the second and third reference noses, and defines two further points of contact between the lamp cap and the edge of the lamp mounting opening. The depressions in the outer side of the support sleeve, and/or the cutouts in the support sleeve are arranged such that they are arranged at the same level as the outer edge of the edge of the lamp mounting opening. These measures ensure that the previously named outer edge is arranged free from contact with the lamp cap, and that any possible formation of burrs on the outer edge causes no maladjustment of the lamp in the mounting opening, designed as a lampholder, of the reflector.

The preferred exemplary embodiment of the invention is a single-filament halogen incandescent lamp which is provided for use in a motor vehicle headlight. This lamp has a vitreous, essentially cylindrical lamp bulb 10 with a pinch foot 10*a* sealed in a gas-tight fashion. The dome 10*b* of the lamp bulb 10 is provided with a light-absorbing coating. Serving as light source is an incandescent filament 11, which is aligned parallel with the axis of the lamp bulb and connected in an electrically conducting fashion to two supply leads 12, 13 which are led out of the pinch foot 10*a* and comprise molybdenum wire. The pinch foot 10*a* of the lamp bulb 10 is fixed in a metal holder which comprises a cup-shaped holder part 14*a*, the intermediate ring 14*e* and the ring-shaped support sleeve 14*b*. In addition to the metal holder 14*a*, 14*b*, the lamp cap also has a plastic cap part 15 which is provided with the electric terminals 16, 17 of the lamp and in which the ring-shaped metal support sleeve 14*b* is anchored. The support sleeve 14*b* has three reference noses 14*c*, lying in one plane, and a press-on spring 14*d* for mounting the lamp in the reflector 20 of a motor vehicle headlight. The sealing of the reflector 20 is performed by means of a silicone sealing ring 19 which bears against the outer wall 20*b* of the reflector 20 and against the plastic cap part 15. FIG. 1 represents the structure of the lamp in accordance with the preferred exemplary embodiment, and its insertion in a headlight.

Figure 2:
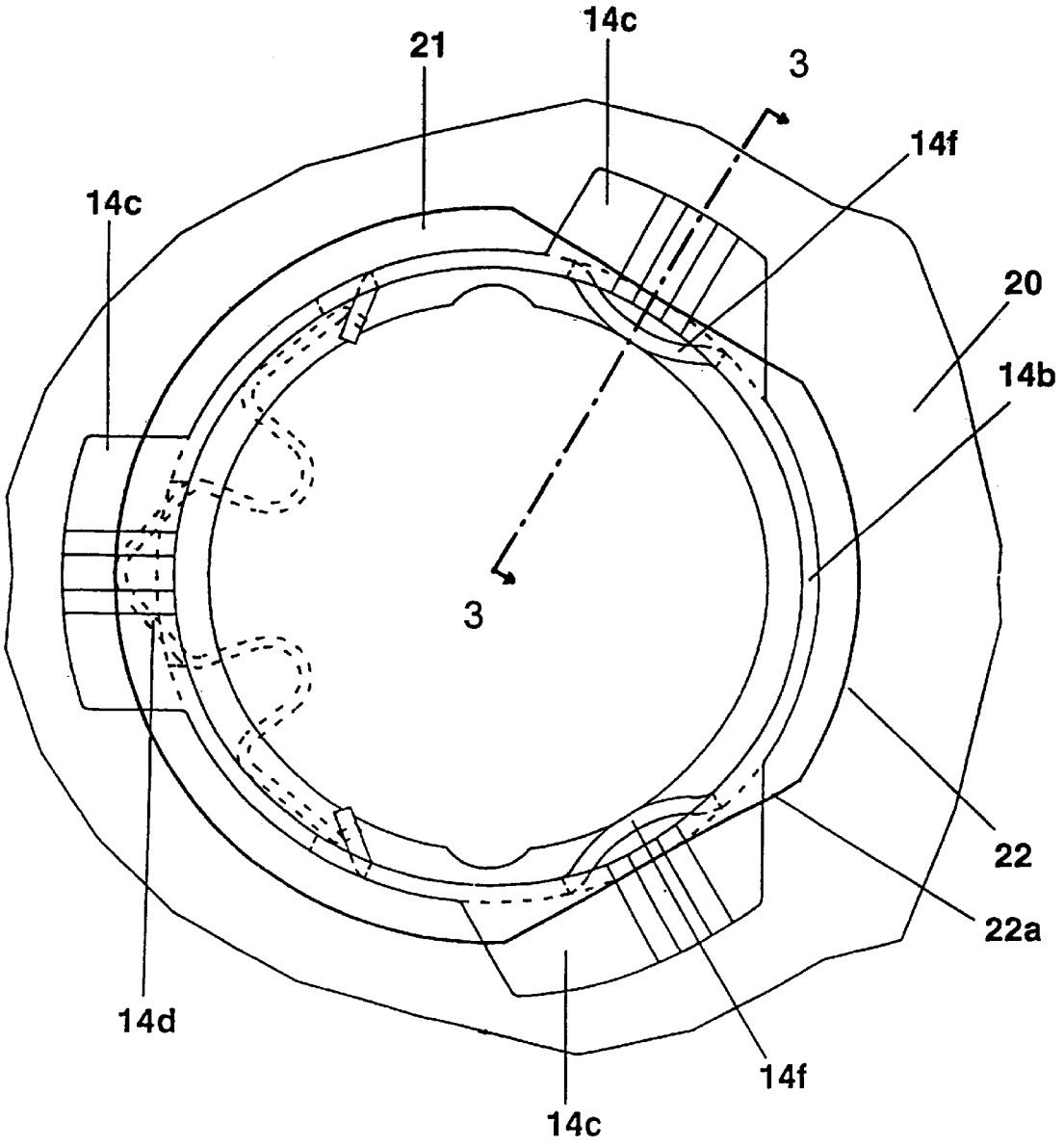
FIG. 2 shows a top view of the connection between the support sleeve of the lamp in FIG. 1 and the lamp mounting opening of the reflector, with the lamp inserted in the reflector.
Figure 3:
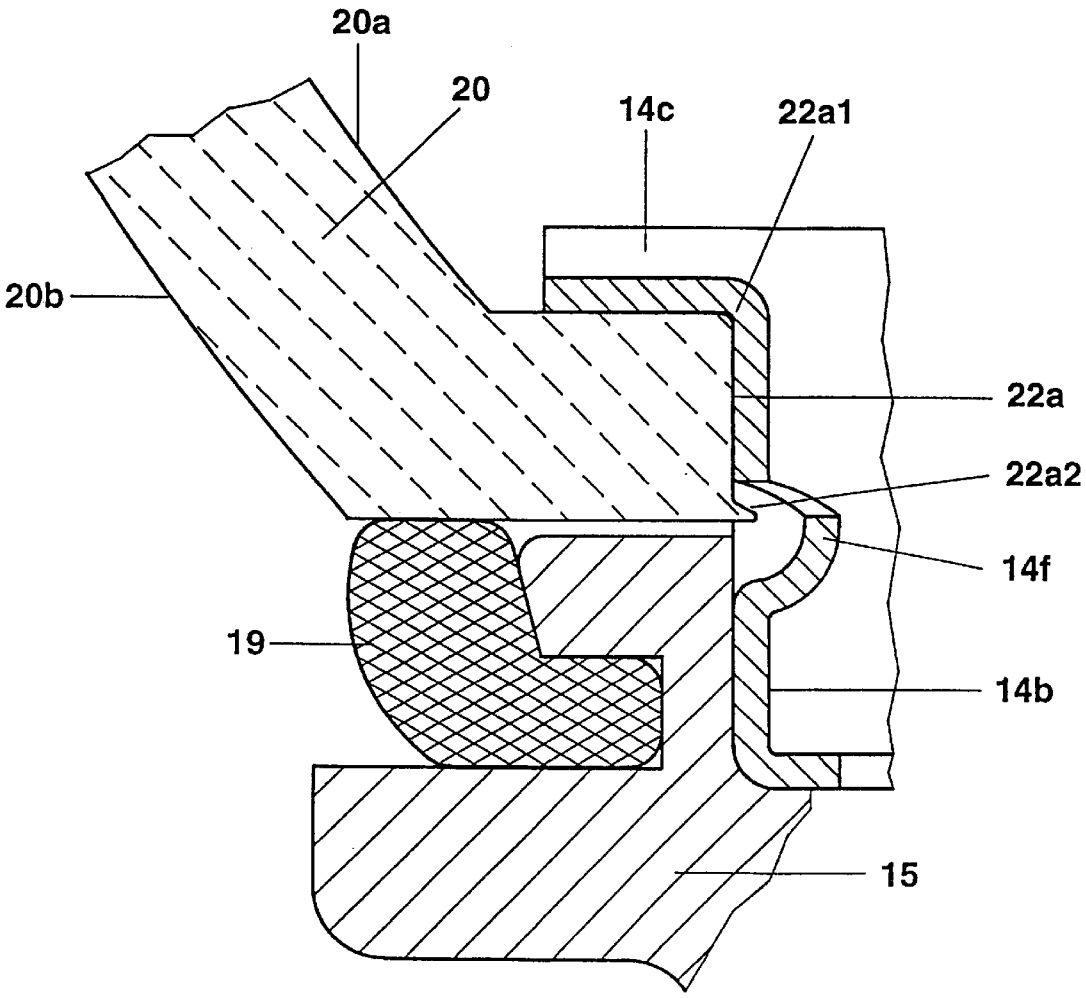
FIG. 3 shows a cross section through the lamp cap and the reflector, along the line of section 3—3 of FIG. 2.

FIGS. 2 and 3 show details of the arrangement of the lamp in the reflector 20 of the motor vehicle headlight. The three reference noses 14*c* engage in the mounting opening 21, designed as a lampholder, of the reflector 20, and bear against the inner side 20*a* of the reflector 20. They 14*c* are distributed equidistantly over the circumference of the ring-shaped support sleeve 14*b*. The press-on spring 14*d* of the support sleeve 14*b* is arranged below a first reference nose 14*c* and bears resiliently against the edge 22 of the lamp mounting opening 21. The outer side of the support sleeve 14*b* respectively has a depression 14*f* below the other two reference noses 14*c*. The depressions 14*f* are respectively arranged at a distance of approximately 2.4 mm below the reference noses 14*c*. The reflector wall has a thickness of 3 mm in the region of the lamp mounting opening 21. The inner edge 22*a*1, which delimits the edge 22 on the reflector inner side 20*a*, and the outer edge 22*a*2, which delimits the edge 22 on the reflector outer side 20*b*, therefore have a spacing of 3 mm. The depressions 14*f* in the outer side of the support sleeve 14*b* are arranged at the same level as the outer edge 22*a*2 of the opening edge 21. In the region of the two above-named other reference noses 14*c*, the edge 22 of the lamp mounting opening 21 of the reflector 20 respectively has a prismatic bearing surface 22*a*. The outer side of the support sleeve 14*b* of the lamp cap bears against these two prismatic bearing surfaces 22*a* with a clamping fit. The clamping action is produced by means of the press-on spring 14d. The contact surfaces between the support sleeve 14*b* and bearing surfaces 22*a* are located below the reference noses 14*c* and above the depressions 14*f*. Because of the depressions 14*f*, the outer edge 22*a*2, possibly affected by a burr, of the edge 22 of the mounting opening 21 is arranged free from contact with the lamp cap and, in particular, with the support sleeve 14*b*.

The invention is not limited to the exemplary embodiment described in more detail above. For example, instead of the two depressions 14*f*, the support sleeve 14*b* can also have in its outer wall a groove which is in the shape of a ring segment and is arranged in the region of the prismatic bearing surfaces 22*a* at the same level as the outer edge 22*a*2. Instead of depressions 14*f*, the support sleeve 14*b* can also have cutouts, that is to say holes in the support sleeve wall.

What is claimed is:

1. An electric lamp comprising: a lamp cap and a transparent lamp bulb (10), and having at least one luminous means (11) surrounded by the lamp bulb (10), the lamp cap having a metal holder part (14*a*) in which the lamp bulb (10) is fixed, the lamp cap having a ring-shaped metal support sleeve (14*b*) connected to the holder part (14*a*) and a plastic cap part (15) which is provided with the electric terminals (16, 17) of the lamp and in which the support sleeve (14*b*) is anchored, the support sleeve (14*b*) having three reference noses (14*c*) lying in a common plane arranged perpendicular to the ring axis, the reference noses (14*c*) serving to engage in an opening (21), designed as a lampholder, of a reflector (20), and the ring-shaped support sleeve (14*b*) having a press-on spring (14*d*) which acts radially outwards and serves to fix the lamp in the opening (21) designed as a lampholder, of the reflector (20), the press-on spring (14*d*) being arranged below a first reference nose (14*c*), characterized in that on its outer side, below the second and third reference nose (14*c*), the ring-shaped support sleeve (14*b*) in each case has a depression (14*f*) or a cutout at a distance from the reference noses (14*c*) and along a surface (22*a*) to otherwise bear against the reflector.

2. An illuminating system comprising: an electric lamp according to claim 1 and having a reflector (20), the reflector (20) having a reflector inner side (20*a*) facing the lamp bulb (10), and a reflector outer side (20*b*) averted from the lamp bulb (10), as well as a light exit opening a mounting opening (21) designed as a lampholder, the mounting opening (21) being delimited by an edge (22) which has an inner edge (22*a*1) on the reflector inner side (20*a*) and an outer edge (22*a*2) on the reflector outer side (20*b*), the reference noses (14*c*) bearing against the reflector (20*a*) on the reflector inner side (20*a*), the press-on spring (14*d*) bearing against the edge (22) of the mounting opening (21), and the support sleeve (14*b*) bearing against the edge (22) of the mounting opening (21) below the second and third reference nose (14*c*), characterized in that the depressions (14*f*) or cutouts are arranged at the same level as the outer edge (22*a*2).

* * * * *